US006856252B2

(12) United States Patent
Pfefferseder et al.

(10) Patent No.: US 6,856,252 B2
(45) Date of Patent: Feb. 15, 2005

(54) METHOD FOR DETECTING FIRES

(75) Inventors: Anton Pfefferseder, Sauerlach-Arget (DE); Bernd Siber, Glonn (DE); Andreas Hensel, Vaihingen (DE); Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 21 days.

(21) Appl. No.: 10/332,254

(22) PCT Filed: Feb. 5, 2002

(86) PCT No.: PCT/DE02/00404

§ 371 (c)(1),
(2), (4) Date: Jan. 6, 2003

(87) PCT Pub. No.: WO02/069297

PCT Pub. Date: Sep. 6, 2002

(65) Prior Publication Data

US 2004/0090335 A1 May 13, 2004

(30) Foreign Application Priority Data

Feb. 27, 2001 (DE) ..... 101 09 362

(51) Int. Cl.[7] ..... G08B 17/10
(52) U.S. Cl. ..... 340/628; 340/632; 340/588
(58) Field of Search ..... 340/628, 630, 340/629, 632, 522, 600, 588, 517

(56) References Cited

U.S. PATENT DOCUMENTS 4,195,286 A 3/1980 Galvin
4,757,303 A 7/1988 Scheidweiler
4,881,060 A 11/1989 Keen et al.
5,084,696 A 1/1992 Guscott et al.
5,369,397 A 11/1994 Wong
5,477,218 A * 12/1995 Manmoto et al. ..... 340/630
5,552,763 A 9/1996 Kirby
5,592,147 A 1/1997 Wing
5,691,704 A * 11/1997 Wong ..... 340/628
5,831,537 A * 11/1998 Marman ..... 340/628
5,966,077 A 10/1999 Wong
5,969,437 A * 10/1999 Foerster ..... 307/66

FOREIGN PATENT DOCUMENTS

DE 198 39 047 A 1/2000
EP 0 721 175 A 7/1996

* cited by examiner

*Primary Examiner*—Anh V. La
(74) *Attorney, Agent, or Firm*—Michael J. Striker

(57) ABSTRACT

A method for detecting fires is proposed that serves to avoid false alarms, by providing that an alarm threshold is determined as a function of signal parameters derived from at least one sensor signal. False alarms are thus advantageously precluded. This is still further improved by setting up an alarm interval for which the alarm threshold must be exceeded, if an alarm is to be indicated. The alarm interval can also be determined adaptively as a function of the signal parameters. An upper threshold and a lower threshold are provided for the alarm interval and the alarm threshold, respectively, in order to build in a certain safety, so that the alarm threshold and alarm interval will not assume values that put a function of the fire detector at risk. It is also possible to use more sensor signals, in which case signal parameters can be generated by linking the sensor signals. As the fire detector, a scattered light smoke detector is preferably used, which is equipped with a labyrinth and a measurement chamber.

13 Claims, 2 Drawing Sheets

METHOD FOR DETECTING FIRES

BACKGROUND OF THE INVENTION

The invention is based on a method for detecting fires.

Fire detectors react to changes in the environment. Among such changes caused by fire are smoke that occurs, a temperature increase, and gases produced in a fire. For detecting these parameters, scattered light sensors are used for smoke detection, temperature sensors are used for detecting the temperature increase, and gas sensors are used for gas detection. With gas sensors, both chemical and physical gas sensors are possible. In a fire detector, sensor signals derived from such sensors are picked up cyclically, specifically by an evaluation circuit. A fire is indicated whenever a predetermined alarm threshold is exceeded by the sensor signal. However, the problem of so-called interference variables that can cause false alarms also exists. These include cigarette smoke, disco fog, dust, and electromagnetic interference.

SUMMARY OF THE INVENTION

In keeping with these objects one feature of the present invention resides, briefly stated, in a method for detecting fires, comprising the steps of detecting a fire from an exceeding of an alarm threshold by at least one sensor signal; determining the alarm threshold as a function of signal parameters derived from the at least one sensor signal; indicating a fire if the alarm threshold is exceeded for an alarm interval; and determining the alarm interval as a function of the signal parameters.

The method of the invention for detecting fires has the advantage over the prior art that the alarm threshold is determined as a function of signal parameters that are denied from the sensor signals. This makes it possible to adapt to situations that might cause a false alarm. That is, it is possible to ignore these situations. Moreover, the sensitivity of a fire detector can be enhanced by adaptation of the alarm threshold, specifically if situations arise that are an indication of a fire, such as a steady increase in smoke. The method of the invention can moreover be implemented in a simple way using a microcontroller and involves only little computation effort or expense.

It is especially advantageous that to indicate a fire, the alarm threshold must be exceeded for an alarm interval. Transient effects are thus advantageously ignored. For instance in a scattered light smoke detector that has a labyrinth, the problem is that when there is a draft, dust is swirled into the labyrinth and leads to an increased sensor signal of the scattered light smoke detector. If the alarm interval is suitable specified, however, it is possible that the sensor signal may drop below the alarm threshold again within the alarm interval, in which case there is no indication of a fire. This advantageously prevents a false alarm. Electromagnetic interference also represents transient effects and is blanked out by using an alarm interval. Even welding can briefly produce smoke, but the scattered light smoke detector detects the smoke as a sign of fire. Once again, this kind of transient effect can be suppressed by means of the alarm interval. It is especially advantageous, however, for the alarm interval also to be determined adaptively as a function of the signal parameters. Thus especially situations in which a very high alarm threshold is determined are made less critical, so that a fire will not be detected too late. This is because in such situations, in the event of a fire, a very high alarm threshold is in fact attained relatively late, and if in addition the alarm interval is made relatively long, then the fire warning cannot be issued until relatively late. This can be compensated for then by providing a shorter alarm interval. If there is also a steady increase in smoke, it is thus possible to react adaptively by providing a short alarm interval, because an increase in smoke is a sign of a developing fire.

It is also advantageous that for both the alarm interval and the alarm threshold, upper thresholds and lower thresholds are defined, which are adjustable as a function of given conditions and of the detector used. Once again, this enhances safety compared with changing the alarm threshold or the alarm interval, so that environmental factors will not cause an alarm threshold to drop too low or be calculated too high. The same is true for the alarm interval.

Determining the alarm interval or alarm threshold can also be adapted to local conditions by adjusting parameters. These include for instance weighting factors, which are used in calculating the alarm threshold or the alarm interval from the signal parameters.

As the signal parameters, the rise speed of the sensor signal and the noise in the sensor signal are advantageously used. The rise speed of the sensor signal is calculated from the sensor signal by using two digital low-pass filters with different time constants and then finding the difference. This difference is in fact a measure of the rise speed. The noise, conversely, is calculated from the sensor signal and from smoothed sensor signal data. The resting value is advantageously made to track it. If there are advantageously at least two different sensor signals, then it is possible to use one sensor signal to check the plausibility of the other sensor signal. This too increases the safety against false alarms. Moreover, linking the sensor signals is possible, and this can be done for instance by means of correlation.

It is furthermore advantageous that there is a device for performing the method of the invention, which is embodied as a fire detector and in particular as a scattered light smoke detector. A communications line, such as a bus, can then connect a signal processing stage of the fire detector with reproduction means or with a control center.

BRIEF DESCRIPTION OF THE DRAWING

Exemplary embodiments of the invention are shown in the drawings and will be described in further detail in the ensuing description. Shown are FIG. 1, a block circuit diagram of the device of the invention.

DESCRIPTION

Figure 1:
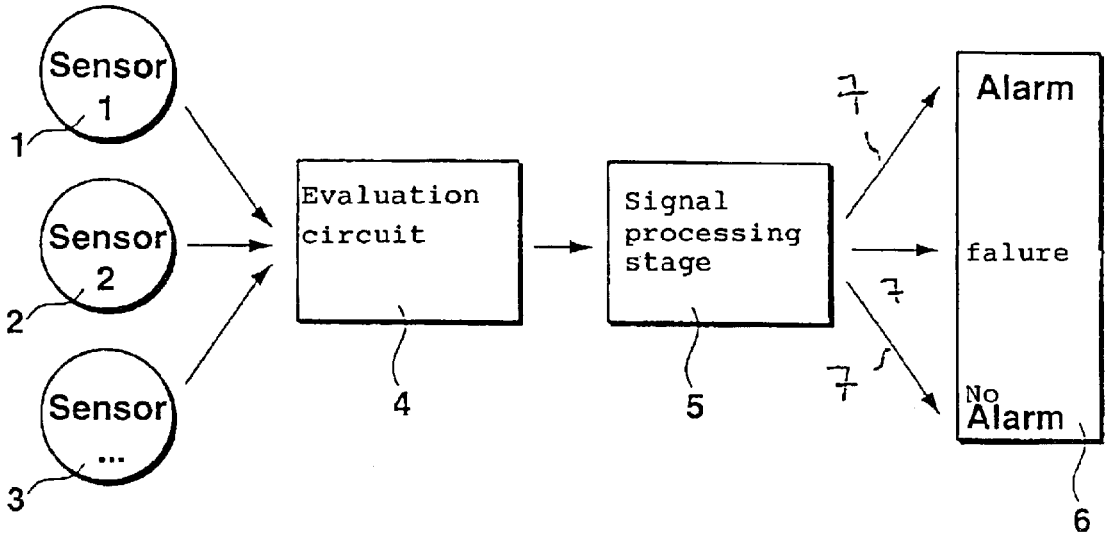

FIG. 1 shows the device of the invention as a block circuit diagram. The sensors 1, 2 and 3 are connected to an evaluation circuit 4, which picks up the sensor signals of the three sensors 1, 2 and 3. The sensor signals thus picked up are then transmitted to a signal processing stage 5, which has a microcontroller, so that signal parameters can be calculated from the sensor signals and the sensor signals can be compared with an alarm threshold. Via a communications line 7, the outcome of the signal processing stage is then transmitted to a reproduction device 6, which can also be a control center.

As an example, three sensors are mentioned here, but it is also possible for only one sensor, or two sensors, or more than two sensors to be used. As the sensor type, a scattered light sensor is used here, which in a labyrinth has a measurement chamber, in which a light source is disposed, and a light receiver; the light receiver receives light only when smoke enters the measurement chamber through the labyrinth and thus scatters light from the light source into the light receiver.

It is also possible as the sensors to use gas sensors, for instance resistive gas sensors that change resistance as a function of the adsorbed gas; to that end, semiconductor sensors can be used. The use of an electrochemical cell is also possible, which outputs a current as a function of the gas that occurs. This current is then proportional to the gas concentration. A temperature sensor can also be used here, since in a fire high temperatures occur and so the use of such a sensor is suitable for detecting a fire.

DESCRIPTION OF THE PREFERRED EMBODIMENT

The evaluation circuit 4 includes a measurement amplifier, filters, and an analog/digital converter, so that the sensor signals can then be transmitted as digital signals to the signal processing stage 5. The signal processing stage 5 has a simple microcontroller, which is connected to a memory so that intermediate results can be stored there, and permanent values that are stored there can be loaded from there. Such functions as digital low-pass filters or digital high-pass filters are then implemented in the microcontroller. It is also possible to use a digital signal processor for this purpose. The communications line 7 can be embodied as a bus, in order to connect the fire detector, which is realized by means of the sensors 1, 2 and 3, the evaluation circuit 4, and the signal processing stage 5, to a control center 6. In the control center a display then tells whether an alarm, a failure of the fire detector, or no alarm exists. Once again, it is possible to use even simple reproduction means, such as a visual display associated directly with the fire detector, or an acoustical playback capability, such as a speaker.

The signal processing stage 5 derives signal parameters from the sensor signals. The signal parameters that are derived here include the rise speed. The rise speed accordingly describes how fast the sensor signal rises. This is accordingly nothing other than the rise of the sensor signal. Another signal parameter is the noise of the sensor signal. This noise is obtained by finding a difference between the raw sensor signal and a smoothed sensor signal. An ensuing quadrature can then be performed, to determine a noise level and via the noise thus calculated, or the noise level, to form a sliding average value. Buffer-storing the sensor signals over a certain period of time, for instance the last sixty-four measured values, and then calculate in the frequency spectrum is also possible. If a low-frequency noise predominates, this is a sign of a fire. High-frequency noise indicates an interference variable.

According to the invention, from the signal parameters for the rise speed and the noise, the alarm threshold and the alarm interval are calculated. The sensor signal is then compared with the altered alarm threshold, and if the alarm threshold is being exceeded, the question is asked whether this situation has persisted until the alarm interval has elapsed. This assessment of the sensor signals is performed cyclically. If an alarm is detected, or an interference is indicated, or no alarm is indicated, this is then transmitted accordingly to the reproduction means 6.

Figure 2:
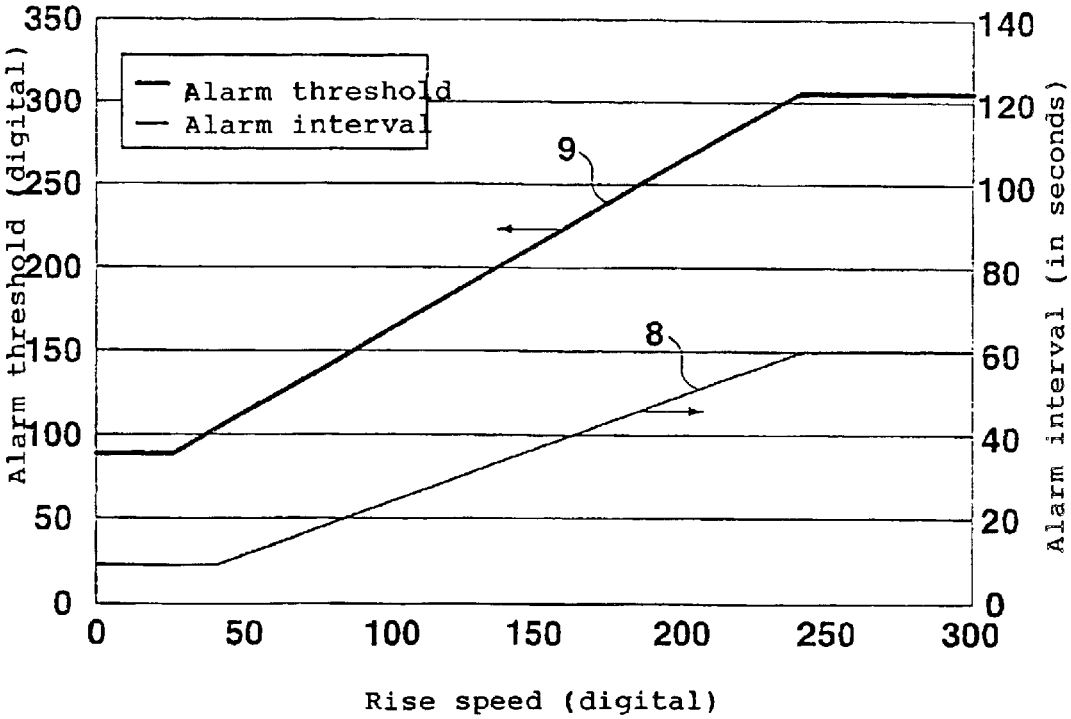
FIG. 2, a graph that illustrates the dependency of the alarm threshold and the alarm interval on the rise speed of the sensor signal.

In FIG. 2, one example for the dependency of the alarm threshold and the alarm interval on the rise speed is shown in a graph. The rise speed is plotted on the abscissa, while the alarm threshold is plotted on the ordinate on the left, and the alarm interval is plotted on the ordinate on the right. The curve 9 describes the alarm threshold. It is constant, up to a value of approximately 25 for the rise speed. This is the lower limit for the alarm threshold. The alarm threshold then rises linearly as a function of the rise speed up to a rise speed of approximately 225. Beyond this value, the upper threshold for the alarm threshold is attained, at an alarm threshold value of approximately 310. For higher rise values than 225, the alarm threshold remains at the value of 310.

The lower curve 8 represents one example for calculating the alarm interval as a function of the rise speed. The alarm interval remains constant at a value of 10 up to a value of the rise speed of approximately 40. Beyond this value for the rise speed, the alarm interval rises linearly up to a value of 60, which is reached at a rise speed value of 240. At higher values of the rise speed than 240, the alarm interval remains constant at 60. That is, the upper threshold for the alarm interval is thus reached.

The determination of the alarm threshold or alarm interval as a function of the noise is performed here as a function of the noise level. The higher the smoke level, the higher the alarm threshold and the longer the alarm interval.

Figure 3:
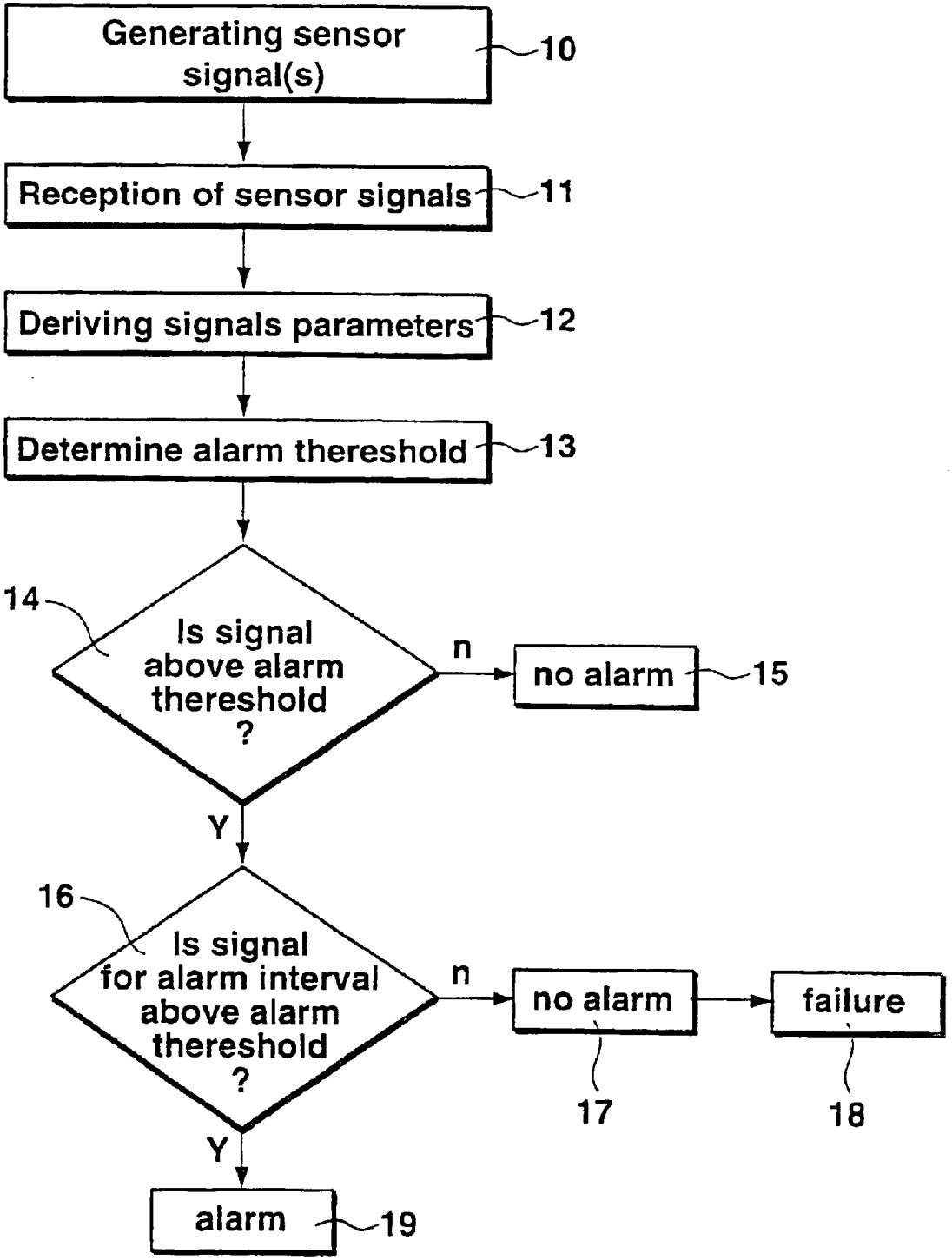
FIG. 3, a flow chart of the method of the invention.

In FIG. 3, the method of the invention is illustrated by a flow chart. In method step 10, the sensor signals are generated by the sensors 1–3. In method step 11, the sensor signals are picked by the evaluation circuit 4, here called "reception". In method step 12, from the sensor signals that have been amplified and digitized by the evaluation circuit 4, the signal processing stage 5 derives the signal parameters for the rise speed and noise. To that end, as described above, digital low-pass filters are used. These digital low-pass filters are implemented in a microcontroller in the signal processing stage 5.

In method step 13, the alarm threshold is calculated from these signal parameters for the rise speed and noise. In method step 14, it is now ascertained whether the sensor signal is above the thus-calculated alarm threshold. If not, then in method step 15 it is recognized that no alarm exists, and this is transmitted to the reproduction device 6. However, if the alarm threshold has been exceeded, then in method step 16 it is asked whether this alarm threshold has been exceeded uninterruptedly for the entire alarm interval. If not, then in method step 17 it is ascertained that no alarm exists, and in method step 18, it is indicated by the reproduction device 6 that a failure has occurred. However, if it is found in method step 16 that the alarm threshold has been exceeded uninterruptedly for the entire time of the alarm interval, then an alarm is detected in method step 19. This is indicated then by means of the reproduction device 6.

Instead of or in addition to the signal parameters for the rise time and noise, still other signal parameters are possible, such as the integrated sensor signal, a correlation of various sensor signals or in other words a cross-correlation, and other linkages of the sensor signals. It is also possible to use a fixed alarm interval, and then to re-determine the alarm threshold again each time as a function of the signal parameters. The reverse is also possible; a fixed alarm threshold can be used, and the alarm interval can be calculated as a function of the signal parameters.

What is claimed is

1. A method for detecting fires, comprising the steps of detecting a fire from an exceeding of an alarm threshold by at least one sensor signal; determining the alarm threshold as a function of signal parameters derived from the at least one sensor signal; indicating a fire if the alarm threshold is exceeded for an alarm interval; and determining the alarm interval as a function of the signal parameters.

2. A method as defined in claim 1; and further comprising determining one upper threshold and one lower threshold as a function of adjustable parameters for at least one of the alarm threshold and the alarm interval.

3. A method as defined in claim 1, and further comprising determining one upper threshold and one lower threshold as a function of adjustable parameters, for the alarm threshold and the alarm interval.

4. A method as defined in claim 1, and further comprising varying the determination of the alarm threshold and alarm interval by means of adjustment.

5. A method as defined in claim 1; and further comprising using as the signal parameters a rise speed and noise of the at least one sensor signal.

6. A method as defined in claim 1; and further comprising when there are at least two different sensor signals, generating signal parameters by linking the sensor signals.

7. A method as defined in claim 1, and further comprising generating the at least one sensor signal by a scattered light sensor.

8. A device for detecting fires, comprising at least one sensor for generating at least one sensor signal; and means for determining the alarm threshold as a function of signal parameters derived from the at least one signal, indicating a fire if the alarm threshold is exceeded for an alarm interval, and determining the alarm interval as a function of the signal parameters.

9. A device as defined in claim 8, wherein said means include an evaluation circuit for detecting the sensor signals and a signal processing stage for processing the sensor signals.

10. A device as defined in claim 9; and further comprising reproducing means for displaying an outcome of processing.

11. A device as defined in claim 10; and further comprising a communication line communicating said signal processing stage with said reproducing means.

12. A device as defined in claim 9, wherein said at least one sensor is a scattered light sensor.

13. A device as defined in claim 12, wherein said scattering light sensor has a labyrinth with a measurement chamber in which a light source and a light receiver are disposed.

* * * * *